US007828055B2

(12) United States Patent
Willauer et al.

(10) Patent No.: US 7,828,055 B2
(45) Date of Patent: Nov. 9, 2010

(54) APPARATUS AND METHOD FOR CONTROLLED DEPLOYMENT OF SHAPE-CONFORMING MATERIALS

(75) Inventors: Darrin L. Willauer, The Woodlands, TX (US); Ping Duan, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 217 days.

(21) Appl. No.: 11/870,992

(22) Filed: Oct. 11, 2007

(65) Prior Publication Data

US 2008/0087431 A1 Apr. 17, 2008

Related U.S. Application Data

(60) Provisional application No. 60/852,275, filed on Oct. 17, 2006.

(51) Int. Cl.
*E21B 43/00* (2006.01)

(52) U.S. Cl. ..... 166/228; 166/376

(58) Field of Classification Search ..... 166/276, 166/376, 227, 228

See application file for complete search history.

(56) References Cited

U.S. PATENT DOCUMENTS

| | | | | |
|---|---|---|---|---|
| 2,981,332 | A | 4/1961 | Miller et al. | 166/12 |
| 2,981,333 | A | 4/1961 | Miller et al. | 166/12 |
| 5,667,011 | A | 9/1997 | Gill et al. | 166/295 |
| 5,833,001 | A | 11/1998 | Song et al. | 166/287 |
| 5,901,789 | A | 5/1999 | Donnelly et al. | 166/381 |
| 6,012,522 | A | 1/2000 | Donnelly et al. | 166/276 |
| 6,232,966 | B1 | 5/2001 | Kurlander | 345/330 |
| 6,253,850 | B1 | 7/2001 | Nazzai et al. | 166/277 |
| 6,263,966 | B1 | 7/2001 | Haut et al. | |
| 6,543,545 | B1 | 4/2003 | Chatterji et al. | |
| 7,013,979 | B2 | 3/2006 | Richard | 166/369 |
| 7,049,272 | B2 * | 5/2006 | Sinclair et al. | 507/230 |
| 2004/0040703 | A1 | 3/2004 | Longmore | |
| 2004/0055758 | A1 | 3/2004 | Brezinski et al. | |
| 2004/0055760 | A1 | 3/2004 | Nguyen | |
| 2005/0056425 | A1 | 3/2005 | Grigsby et al. | |
| 2005/0205266 | A1 | 9/2005 | Todd et al. | |

FOREIGN PATENT DOCUMENTS

| | | | |
|---|---|---|---|
| WO | WO2008008684 | A | 1/2008 |

* cited by examiner

*Primary Examiner*—William P Neuder
*Assistant Examiner*—Catherine Loikith
(74) *Attorney, Agent, or Firm*—Mossman Kumar & Tyler PC

(57) ABSTRACT

An apparatus and method for filling a defined space, such as an annulus around a production tubular within a wellbore, includes a compliant porous material. The compliant porous material can be compressed and maintained in a compressed state by incorporation of a deployment modifier which may be a water-soluble or oil-soluble adhesive or biopolymer, used as an impregnant, a coating, or a casing. The production tubular can be positioned at a desired location and the compliant porous material exposed to a deployment modifier neutralizing agent, which then dissolves or otherwise prevents the deployment modifier from continuing to inhibit the deployment. Thus, deployment can be delayed to an optimum time by controlling exposure of the deployment modifier to the deployment modifier neutralizing agent.

18 Claims, No Drawings

APPARATUS AND METHOD FOR CONTROLLED DEPLOYMENT OF SHAPE-CONFORMING MATERIALS

CROSS-REFERENCE TO RELATED APPLICATIONS

This application claims priority from U.S. Provisional Patent Application Ser. No. 60/852,275 filed Oct. 17, 2006.

FIELD OF THE INVENTION

This invention relates to shape-conforming materials, and more particularly to those that can be expanded downhole to form screens or to isolate a portion of a formation.

BACKGROUND ART

In the past various methods have been used to provide materials that are capable of filling as much of the annular space between production tubing and a wellbore wall as possible, in both cased and open hole wellbores. Two particular situations have required specialized materials or structures for this purpose. These situations include sand control and isolation of a portion of the formation.

Sand control, in particular, has been a problem addressed by many inventions. In general, sand control methods have been dominated by the use of gravel packing outside of downhole screens. The goal is to fill the annular space outside of the screen with sand which will operate to prevent the production of undesirable solids from the formation, while still allowing flow of desirable production fluids. More recently, with the advent of tubular expansion technology, it has been thought that the need for gravel packing might be eliminated if the screen or screens could be expanded in place to eliminate the surrounding annular space that had heretofore been packed with sand. However, problems have been encountered with the screen expansion technique because of wellbore shape irregularities. While a fixed swage can be used to expand a screen by a fixed amount, it does not effectively address the problem of wellbore irregularities. Furthermore, a washout in the wellbore can result in formation of a large annular space outside of the screen, while an area of unanticipatedly small diameter in the wellbore can result in sticking of the fixed swage, causing problems in getting the fixed swage to the desired location.

One improvement over the fixed swage is the flexible swage, for which various designs exist. These swages flex inwardly in tight areas, which may reduce the chance of sticking. Unfortunately, flexible swages still have a finite expansion capability, and therefore the problem of annular gaps or voids beyond the range of the swage remains unaddressed.

Alternative screen designs have included use of a pre-compressed mat held by a metal sheath, that is then subjected to chemical attack when placed in a desired downhole location. Once in position the mat is allowed to expand from its pre-compressed state, but the screen itself does not expand. Examples of this design and other alternatives are described in, for example, U.S. Pat. Nos. 2,981,332; 2,981,333; 5,667,011; 5,901,789; 6,012,522; 6,253,850; 6,263,966; 5,833,001; and 7,013,979 B2. Unfortunately, many of these designs suffer from the problem of relatively rapid "locking in" of the space-filling means at a given location following its introduction downhole. This rapid "lock-in" in many instances prevents or discourages the repositioning of the device for optimum performance, and frequently requires costly remediation efforts to ensure the goals of the device are adequately met.

Thus, what is needed in the art is a means and method of enabling filling of an annular downhole space in a way that reduces the incidence of unfilled voids and that ensures that goals such as, for example, sand control or annular isolation, can be accomplished. It is also desirable that such means and method offer improved flexibility in positioning or repositioning a space-filling means within an acceptable time period.

SUMMARY OF THE INVENTION

Accordingly, the invention includes, in one aspect, an apparatus comprising a compliant porous material and a deployment modifier. In this apparatus the compliant porous material is compressed to a compressed state and the compressed state of the compliant porous material is retained by the deployment modifier.

In another aspect the invention includes a method of fully or partially filling a downhole area with a compliant porous material. The method comprises preparing an apparatus that includes a compliant porous material and a deployment modifier. The compliant porous material is compressed to a compressed state and the compressed state is retained by the deployment modifier. The apparatus is positioned downhole in an area to be fully or partially filled and then the deployment modifier is exposed to a deployment modifier neutralizing agent for a sufficient time such that the compliant porous material expands to fully or partially fill the downhole area.

In still another aspect the invention includes an apparatus comprising a production tubular, a compliant porous material, and a deployment modifier. The compliant porous material forms a layer on the production tubular, and is compressed from its original size and shape. In this apparatus the deployment modifier is incorporated with the compliant porous material such that the compliant porous material remains compressed until the deployment modifier is exposed to a deployment modifier neutralizing agent for a sufficient time. Upon this event the compliant porous material expandably deploys toward its original size and shape.

In yet another aspect the invention includes a method for fully or partially filling an annular space surrounding a production tubular in a wellbore. The method comprises preparing a compliant porous material layer at least partially surrounding the exterior annulus of a production tubular. The compliant porous material layer is compressed by compressive forces from its original size and shape and is selected such that it will deploy toward its original size and shape upon removal of compressive forces. The compliant porous material layer comprises a water-soluble or oil-soluble deployment modifier capable of inhibiting the compliant porous material layer from deploying until the deployment modifier is exposed for a sufficient time to a deployment modifier neutralizing agent, at which point the compliant porous material layer expandably deploys toward its original size and shape. The production tubular is positioned within a wellbore at a desired location, and then exposed to a deployment modifier neutralizing agent. As a result, the compliant porous material layer expands to fully or partially fill the annular space.

In still another aspect, the invention includes a method for sand control in a wellbore. The method comprises preparing a compliant porous material layer at least partially surrounding the exterior annulus of production tubular. In this location the compliant porous material is compressed from its pre-compression state to a compressed state, and retained in a compressed state by a deployment modifier. The deployment modifier is capable of inhibiting the compliant porous material layer from deploying toward its pre-compression state until the deployment modifier is exposed for a sufficient time to a solvent therefore. The production tubular is positioned within a wellbore at a desired location, and the compliant porous material layer is then exposed to the solvent for a sufficient time, such that the deployment modifier is at least partially dissolved. The compliant porous material layer then expandably deploys toward its pre-compression state within the wellbore.

DETAILED DESCRIPTION OF THE INVENTION

The invention in general includes the selection and use of a material that is capable of expandably filling a space and that can be compressed to a size and shape that are reduced relative to the original size and shape, and then deployed, that is, allowed or initiated to expand to or toward the original size and shape, in order to accomplish its space-filling goal, at a point in time that is relatively removed from the time of the material's initial introduction into the space. This invention is particularly useful when the goal is to fill a borehole space, whether open hole or cased. This material, which may be selected to serve as an apparatus such as a sand screen or component thereof, an annular isolator or component thereof, or a combination thereof, may offer to skilled drill rig operators adequate time and opportunity to optimally position such an apparatus and still ensure a tight "fit" within the wellbore without significant edge voids, regardless of anomalies in the shape or construction of the wellbore. To do this, the invention enables the operator to inhibit, slow or prevent deployment of the space-filling apparatus during movement of a conveying means, such as of a production tubular, from the surface to a desired location. Thereafter, once the desired location is obtained and positioning has been accomplished, deployment of the space-filling apparatus may be initiated and proceed to desired completion.

The invention includes both apparatus and method of use. The apparatus may be of any type suited to, for example, filling an annulus within a borehole in a location surrounding one or more production tubulars. In this embodiment the invention may comprise a layer surrounding or on a portion of such a tubular. As used herein, the term "production tubulars" is defined to include, for example, any kind of tubular that is used in completing a well, such as, but not limited to, production tubing, production casing, intermediate casings, and devices through which hydrocarbons are to be flowed to the surface. Examples of such apparatus include, in non-limiting embodiments, sand control assemblies, annular isolators used to block off non-targeted production or water zones, selective control devices such as sliding sleeves, and the like. The method includes methods for use as sand control assemblies, annular isolators, and the like, as well as any uses in which space-filling following placement is desired. Because the space-filling apparatus forms a layer around the production tubular, it is alternatively hereinafter in some embodiments termed as a "layer."

The layer of the invention is prepared of a compliant porous material which may include, but not be limited to, syntactic and conventional memory foams and combinations thereof. As used herein, the term "memory" refers to the capability of a material to withstand certain stresses, such as external mechanical compression, vacuum and the like, but to then return, under appropriate conditions, to, or at least toward, the material's original size and shape. In general, conventional foams are those prepared from a medium, in many embodiments offering elastomeric properties, which has been "foamed," that is, formed into a solid structure by expansion resulting from bubbles, the bubbles having resulted from introduction into the foaming medium of air or any gas or combination of gases such that the foaming medium is expanded to form cells of any dimension. Conversely, syntactic foams are lightweight engineered foams manufactured by embedding hollow spheres, typically of glass, ceramic or polymers, in a resin matrix. The embedded spheres are then removed, frequently but not necessarily by dissolution, leaving a solid material with a porous structure.

In certain non-limiting embodiments the foam may be either open cell or closed cell, and the selection of such will generally depend upon the desired goal of the space-filling apparatus. Open cell foams, for example, are those foams wherein a significant proportion of the cell walls that form during the foaming process are either also broken during that process, or are broken thereafter, by means such as subjection to mechanical forces. Regardless of how the open cell structure is attained, the foam may be, in certain non-limiting embodiments, sufficiently porous so as to enable the passage of production fluids therethrough. This type of foam may be particularly suited for use in sand control assemblies, particularly where most of the pores of the cells have a diameter that is insufficient to allow passage therethrough of a majority, or most, produced solids, for example, of sand, alternatively referred to as "fines." In contrast, closed cell foams may be more suited to use in annular isolation apparatuses, where it is desired to prevent most or all passage of wellbore materials, either liquid or solid, or both, therethrough.

The types of materials that are suitable for preparing the compliant porous material include any that are able to withstand typical downhole conditions without undesired degradation. In non-limiting embodiments such may be prepared from a medium or media that is or are either thermoset or thermoplastic. This medium may contain a number of additives and/or other formulation components that alter or modify the properties of the resulting compliant porous material. For example, in some non-limiting embodiments the compliant porous material may be selected from the group consisting of polyurethanes, polystyrenes, polyethylenes, epoxies, rubbers, fluoroelestomers, nitriles, ethylene propylene diene monomers (EPDM), combinations thereof, and the like.

In certain non-limiting embodiments the compliant porous material may have a "shape memory" property. As used herein, the term "shape memory" refers to the ability of the material to be heated above the material's glass transition temperature, and then be compressed and cooled to a lower temperature while still retaining its compressed state. However, it may then be returned to its original shape and size, that is, its pre-compressed state, by reheating above its glass transition temperature. This subgroup, which may include certain syntactic and conventional, that is, so-called "blown" foams wherein a gas is used to induce bubble formation in the foaming medium, may be formulated to achieve a desired glass transition temperature for a given application. For instance, a foaming medium may be formulated to have a transition temperature just slightly below the anticipated downhole temperature at the depth at which the annulus-filling apparatus will be used, and then either blown as a conventional foam or used as the matrix of a syntactic foam.

The initial, as-foamed shape of the compliant porous material layer may vary, though an essentially cylindrical shape is usually particularly well suited to downhole wellbore deployment for annulus-filling purposes. Concave ends, striated areas, etc., may also be included in the design to facilitate deployment, or to enhance the filtration characteristics of the layer, for example, in cases where it is to serve a sand control purpose.

In addition to selection of a compliant porous material, the present invention requires selection of an appropriate "deployment modifier." A "deployment modifier", as used herein, may be generally defined as any means by which the deployment, that is, expansion to or toward original size or shape of the foam after its compression, is modified. Such modification is generally a lengthening of the time between the compression, including any reduction in size/shape of the compliant porous material, and its resilient expansion back to its original size and shape. The deployment modifier may be any physical material which can be combined with or applied to the compliant porous material to modify such deployment. For example, the deployment modifier may, in some embodiments, be selected from the group consisting of water-soluble and oil-soluble adhesives, water-soluble and oil-soluble biopolymers, and combinations thereof. In certain non-limiting embodiments it may be selected from, for example, the group consisting of polyvinyl acetate (PVA), polyvinyl alcohol, (PVAI or PVOH), polyvinyl acetate emulsions, carboxymethylcellulose, methylcellulose and hydroxypropyl methylcellulose, hydroxyethylcellulose, copolymers of acrylamide and a cationic derivative of acrylic acid, polylactic acid (PLA), cellulose acetate (CA), blow starch (BA), acrylamide polymers, combinations thereof, and the like.

This deployment modifier may be included with the foam by various means and in various constructions, and in certain particular, non-limiting embodiments it may be incorporated with the compliant porous material either before or after compression to an interim size and shape. This interim size and shape may alternatively be referred to herein as the compliant porous material's "compressed state." As used herein, the term "compression" means the result of the application of any force or combination of forces that reduces the overall exterior surface dimension of the foam, and thus, any "compressed" foam is one that has had its overall exterior surface dimension reduced as a result of such force or forces. Such forces may include, but not be limited to, simple mechanical compression from outside of the foam such as that accomplished by a mechanical press, a hydraulic bladder, or a swaging process, as well as vacuum and the like. The incorporation may be accomplished by, for example, immersing the original compliant porous material into, and allowing it to absorb, the deployment modifier until maximum weight gain of the compliant porous material is achieved. Additional absorption, and size reduction, may be obtained by drawing a vacuum on the compliant porous material. In some cases a deployment modifier, such as a water-soluble or oil-soluble adhesive, may be dissolved in a solvent such as water, alcohol or an organic liquid in order to control the adhesive's concentration level and viscosity. Injection may also be used to incorporate the deployment modifier with the compliant porous material. Once the deployment modifier is in the compliant porous material, the material may then be compressed and the compression maintained while the deployment modifier is allowed to dry or cure to "lock in" the compressed size and shape. In still other non-limiting embodiments the deployment modifier may be coated or "painted" onto the compressed compliant porous material. It may alternatively be formed into a sheet or film and used to encase the exterior, exposed surfaces of the foam. Combinations of any or all of these methods may be used, and more than one deployment modifier may be used with any method or combination of methods.

In some non-limiting embodiments the deployment rate of the compliant porous material is controlled primarily by the level and type of deployment modifier that is used. For example, a higher loading level or higher concentration of a deployment modifier may be employed in order to extend the deployment time. Alternatively or in addition, the deployment modifier having a slower dissolution rate and/or solubility rate may be selected for the same purpose. In other non-limiting embodiments, an appropriate deployment modifier may be combined with, as the compliant porous material, a shape memory foam having a glass transition temperature that approximates the anticipated downhole temperature at the location where the apparatus of the invention will be deployed. Thus, the tendency of the shape memory foam to return to or toward its decompressed state at that temperature may be advantageously employed to initiate, or augment initiation of, deployment, while the deployment modifier will prevent such initiation until a desired time following arrival at the desired location. Another method of effectively controlling deployment may be to select as a deployment modifier a combination of two or more compounds having different dissolution rates.

In some non-limiting embodiments, the compliant porous material of the invention surrounds one or more production tubulars, frequently as a layer, which may be full or partial. In some non-limiting embodiments the compliant porous material layer may be prepared in situ, adhered onto the production tubular itself as the foaming gas is incorporated into the foaming medium in conventional foam technology, with the foam thereafter compressed and, either before or after compression, immersed into or injected with a deployment modifier. In this embodiment the production tubular is then ready to be introduced into the wellbore. In other non-limiting embodiments a suitable foam may be prepared independently, slid onto or collared around the production tubular in either compressed or uncompressed state, and deployment-modified or deployment-unmodified state, such that it surrounds, in whole or in part, the tubular. If such is not yet deployment-modified, a suitable deployment modifier is then added or incorporated via an effective means, and if such is not yet compressed, appropriate compression is carried out. Once the appropriate steps have been taken, the production tubular is then ready for introduction into the wellbore. In such embodiments suitable adhesive means may be used to ensure that the foam remains in place on the production tubular during transit to the production tubular's desired downhole deployment location. As will be immediately recognized by those skilled in the art, suitable adhesive means will be any which accomplish the goal without subjecting either the foam, the deployment modifier, or the production tubular to undesired degradation or other effects. For example, if an epoxy foam is used, an epoxy adhesive may be particularly useful for attaching the foam to the production tubular.

Once the apparatus of the invention, comprising production tubular and its surrounding compliant porous material (which, in some embodiments, may include a plurality of such layers), is introduced into the wellbore and conveyed to its desired location, it will desirably, in non-limiting embodiments of the invention, remain in a substantially compressed state. Because the compliant porous material remains substantially in its compressed state, being frequently a generally cylindrical construction having a radius that is somewhat less than the overall wellbore radius, it can be moved, positioned, and repositioned as desired, and will not deploy because of the effect of the deployment modifier. However, once the drill rig operator has decided that the location of the production tubular and associated compliant porous material layer have been optimized, this deployment may be easily initiated and carried out via exposure of the deployment modifier to a deployment modifier neutralizing agent.

As defined herein, the "deployment modifier neutralizing agent" is any material that dissolves, removes or otherwise deactivates any deployment modifier such that deployment to or toward the pre-compression state of the compliant porous material is enabled. In some particularly convenient embodiments, water, brine or oil may be introduced as a solvent into the wellbore at approximately the location of the compliant porous material. At this location the deployment modifier is exposed to the solvent and because it is, as appropriate and, for example, a water-soluble or oil-soluble adhesive or biopolymer, it begins to at least partially dissolve. Once dissolution has progressed to a sufficient extent, such deployment occurs, usually within a relatively short time thereafter. In alternative embodiments the deployment modifier neutralizing agent may react with the deployment modifier such that the deployment modifier no longer operates to modify deployment. Because the compliant porous material layer exhibits, by its nature, a certain resilience and is sized and shaped (in its pre-compression state) to contact the wellbore wall, generally within a radius that is to some extent less than the overall annular radius of the pre-compressed compliant porous material layer, the deployed compliant porous material layer pushes into and fills voids and irregularities in the sides of the wellbore and may make optimum contact with the wellbore wall. Such contact may thus be tailored to effect a gasket-like fit around the production tubular, and may control (that is, allow or inhibit, depending upon the goal) the flow of sand and/or production fluids therethrough, as desired.

In certain non-limiting embodiments, where a shape memory foam has been selected as the compliant porous layer, a source of heat, alone or in addition to the inherently higher downhole temperature to which the apparatus of the invention is exposed, may be employed to help to initiate or to augment or assist deployment. Such alternative heat source could, in some non-limiting embodiments, be a wireline deployed electric heater, or a battery fed heater. In such embodiment the heat source could be mounted to a production tubular, incorporated into it, or otherwise mounted in contact with the shape memory foam layer. The heater could also, in other non-limiting embodiments, be controlled from the surface at the well site, or it could be controlled by a timing device or a pressure sensor. In still another embodiment, an exothermic reaction could be created by chemicals pumped downhole from the surface, or heat could be generated by any other suitable means.

The desired downhole location for use will include, in some non-limiting embodiments, production zones wherein sand control is desired; production zones to be blanked; areas where annular isolation is desired; junctions between two tubulars such as in the case of multilaterals; and the like. Where the present invention is used in or as a sand control apparatus, appropriate selections of a foaming medium and deployment modifier, as well as appropriate levels and selections of gases or microspheres to blow or form the foam, according to whether it is a conventional or syntactic foam, are desirable to optimize the characteristics of the deployed foam to fulfill such sand control function. Such selections may serve to ensure the desired quality and quantity of production fluids obtained from the well. These desired characteristics will typically include considerations that are well known to those skilled in both the drilling and foam-preparation arts, including, for example, density, average porosity diameter, uniformity of porosity, resistance to degradation upon exposure to hydrocarbons, water, and/or brine, selection of and compatibility of the foaming formulation with the deployment modifier, time to full deployment, foam resilience, combinations thereof, and the like.

If the apparatus of the invention is to be employed for the purpose of annular isolation, such as "blanking" of a non-targeted production zone, many similar foam characteristics will desirably be considered and tailored to the purpose, but will, in many cases, differ from those characteristics sought for sand control. For example, for annular isolation porosity will be desirably minimized, and therefore greater density and a generally smaller cell character may, in some embodiments, be sought. Tolerance to porosity may also be affected by, or affect, decisions relating to the selection of, and particularly means of inclusion or incorporation of, the deployment modifier. Additionally, the compliant porous material may be produced with either an outer or inner skin, or both, such that the skin resides on one or more outboard ends. If a skin is present, it may need to be removed from at least a portion of the compliant porous material, prior to the time at which deployment is desired, in order to hydrostatically pressure balance the material. This pressure balancing is generally desirable to enable deployment.

Regardless of the ultimate goal of the apparatus and method of the invention, an advantage thereof is that deployment time is generally delayed and may be controlled with a relatively high degree of precision, depending upon selection and application of the parameters of the invention. In general, the deployment time, from initiation of deployment to a point at which the compliant porous material has returned 90 percent of the way to its original size and shape, may be increased by at least about 200 percent, and in certain desirable embodiments such increase may be at least about 400 percent, when compared to deployment of an identical construction using the same compliant porous material, but without a deployment modifier. Furthermore, it will be obvious to those skilled in the art that the point of initiation itself may be determined, with relative precision, by the skilled rig operator, since deployment will, by definition, not initiate until the deployment modifier is subjected to an appropriate deployment modifier neutralizing agent for a sufficient time period.

The preceding description and the following comparative example are not intended to define or limit the invention in any way. Those skilled in the art will be fully aware that selections of foaming media and formulations and combinations thereof; deployment modifiers and combinations and configurations thereof; starting materials and preparation conditions for any component or combination of components; reaction protocols; compliant porous material layer and production tubular configurations and types; and the like; may be varied within the scope of the claims appended hereto.

COMPARATIVE EXAMPLE

Two identical shape memory epoxy foam samples are prepared with an initial compression of 400 percent. The first sample, which is a comparative, is subjected to 180° F. water and requires approximately 13 minutes to obtain approximately 90 percent deployment. The second sample, which is a sample of the invention, is filled, via immersion while compacted, with a 5 percent loading of polyvinyl alcohol (Kuraray™ HR-3010) as a deployment modifier, and then dried. This second sample is then subjected to 180° F. water and requires approximately 130 minutes from initiation to obtain 90 percent deployment. In this case the deployment modifier slows the deployment rate by an order of magnitude.

We claim:

1. An apparatus comprising:

a compliant porous material comprising a shape memory property and a deployment modifier selected from the group consisting of:

water-soluble adhesives selected from the group consisting of polyvinyl acetate (PVA), polyvinyl alcohol, (PVAI or PVOH), polyvinyl acetate emulsions, copolymers of acrylamide and a cationic derivative of acrylic acid, acrylamide polymers, and combinations thereof, oil-soluble adhesives, water-soluble biopolymers selected from the group consisting of cellulose acetate (CA), blow starch (BA), and combinations thereof, oil-soluble biopolymers, and combinations thereof, the compliant porous material being compressed and the compression being retained by the deployment modifier.

2. The apparatus of claim 1 wherein the compliant porous material is a memory foam.

3. The apparatus of claim 1 further comprising a deployment modifier neutralizing agent.

4. The apparatus of claim 3 wherein the deployment modifier neutralizing agent is selected from the group consisting of water, oil, and combinations thereof.

5. The apparatus of claim 1 further comprising a production tubular, and the compliant porous material forms a layer around the production tubular.

6. A method for filling a downhole area with a compliant porous material comprising:

preparing an apparatus comprising a compliant porous material and a deployment modifier, the compliant porous material comprising a shape memory property and being compressed from its original size and shape and the compression being retained by the deployment modifier;

positioning the apparatus downhole in an area to be filled; and exposing the deployment modifier to a deployment modifier neutralizing agent such that the compliant porous material expandably deploys toward its original size and shape;

where the deployment modifier is selected from the group consisting of:

water-soluble adhesives selected from the group consisting of polyvinyl acetate (PVA), polyvinyl alcohol, (PVAI or PVOH), polyvinyl acetate emulsions, copolymers of acrylamide and a cationic derivative of acrylic acid, acrylamide polymers, and combinations thereof, oil-soluble adhesives, water-soluble biopolymers selected from the group consisting of cellulose acetate (CA), blow starch (BA), and combinations thereof, oil-soluble biopolymers, and combinations thereof.

7. The method of claim 6 wherein the compliant porous material is selected from the group consisting of syntactic and conventional memory foams and combinations thereof.

8. The method of claim 6 wherein the deployment modifier neutralizing agent is selected from the group consisting of water, oil, and combinations thereof.

9. The method of claim 6 wherein the apparatus further comprises a production tubular, and the compliant porous material forms a layer on the production tubular.

10. An apparatus comprising a production tubular, a compliant porous material comprising a shape memory property, and a deployment modifier selected from the group consisting of:

water-soluble adhesives selected from the group consisting of polyvinyl acetate (PVA), polyvinyl alcohol, (PVAI or PVOH), polyvinyl acetate emulsions, copolymers of acrylamide and a cationic derivative of acrylic acid, acrylamide polymers, and combinations thereof, oil-soluble adhesives, water-soluble biopolymers selected from the group consisting of cellulose acetate (CA), blow starch (BA), and combinations thereof, oil-soluble biopolymers, and combinations thereof;

wherein the compliant porous material forms a layer on the production tubular, and wherein the compliant porous material is compressed from its original size and shape, and wherein the deployment modifier is incorporated with the compliant porous material such that the compliant porous material remains compressed until the deployment modifier is exposed to a deployment modifier neutralizing agent, upon which the compliant porous material expandably deploys toward its original size and shape.

11. The apparatus of claim 10 wherein the compliant porous material is a syntactic or conventional memory foam selected from the group consisting of thermoset and thermoplastic foams, and combinations thereof.

12. The apparatus of claim 10 wherein the deployment modifier is absorbed into, coated onto, or encases the compliant porous material as a film or sheet.

13. The apparatus of claim 12 wherein the deployment modifier is absorbed into the foam by immersion or injection, either before or after compression.

14. The apparatus of claim 10 wherein the deployment modifier neutralizing agent is selected from the group consisting of water, oil, and combinations thereof.

15. The apparatus of claim 10 where the compliant porous material is a conventional memory epoxy foam and the deployment modifier is polyvinyl acetate (PVA).

16. The apparatus of claim 10 being a sand control or annular isolation apparatus.

17. The apparatus of claim 16 wherein the memory foam is selected from the group consisting of open cell foams having an average pore diameter suitable to allow passage of a production fluid therethrough and to inhibit passage of a majority of production solids therethrough, closed cell foams wherein passage of production fluids therethrough is substantially inhibited, and combinations thereof.

18. The apparatus of claim 10 wherein deployment time to about 90 percent deployment is increased by at least about 200 percent when compared to a similar apparatus without a deployment modifier.

* * * * *